US005908107A

United States Patent [19]

Baudin

[11] Patent Number: 5,908,107

[45] Date of Patent: Jun. 1, 1999

[54] PACKAGING FOR THE EXTEMPORANEOUS MIXING OF TWO PRODUCTS

[75] Inventor: Gilles Baudin, Domont, France

[73] Assignee: L'Oreal, Paris, France

[21] Appl. No.: 09/072,981

[22] Filed: May 6, 1998

[30] Foreign Application Priority Data

May 6, 1997 [FR] France ..... 97 05588

[51] Int. Cl.[6] ..... B65D 25/08

[52] U.S. Cl. ..... 206/221; 215/DIG. 8

[58] Field of Search ..... 206/219, 221, 206/568; 215/DIG. 8

[56] References Cited

U.S. PATENT DOCUMENTS 5,277,303 1/1994 Goyet et al. ..... 206/219 X
5,647,481 7/1997 Hundertmark et al. ..... 209/219

FOREIGN PATENT DOCUMENTS 528707 2/1993 European Pat. Off. .
2687640 8/1993 France .

*Primary Examiner*—Jacob K. Ackun
*Attorney, Agent, or Firm*—Oblon, Spivak, McClelland, Maier & Neustadt, P.C.

[57] ABSTRACT

Packaging, especially for the extemporaneous mixing of two products, includes two bottles separated by a connector (8) bearing a removable stopper. The connector means (8) includes two separate parts, a first part (80) bearing the top (88) of a central hollow shaft supporting the stopper (10) which can be screwed in leaktight fashion onto the base of the first bottle, a second part (82) fitted onto the first bottle, which forms a bottom of the central hollow shaft, bearing means (29) which assist in expelling the stopper so that the products can be mixed, and an anti-rotation device for preventing the second part (82) from rotating with respect to the first (80).

22 Claims, 4 Drawing Sheets

PACKAGING FOR THE EXTEMPORANEOUS MIXING OF TWO PRODUCTS

BACKGROUND OF THE INVENTION

1. Field of the Invention

The present invention relates to packaging and particularly to packaging for products which are extemporaneously mixed. The invention is particularly suited to products such as those used in the field of hair colouring, where it is necessary to package a colorant solution intended for dyeing the hair and an oxidizing agent where the solution and the agent are not mixed until the product is to be used.

2. Description of the Related Art

A typical package used for products that are to be mixed before use includes a first bottle with a detachable stopper provided in its base, a second bottle, and connecting means for connecting the two bottles to each other so that their respective contents can be mixed within the two bottles. For example, patent FR 2,680,357 discloses packaging of this type in which the connecting means consist of a band shaped connecting piece which fulfils a number of functions. The connecting piece supports the stopper, provides a leaktight attachment between the first bottle and the second bottle and defines the outer trim for the region of connection between the two bottles. The connecting piece is snap-fastened onto the base of the first bottle, sealing being provided by force-fitting a portion of the connecting piece onto the first bottle. The sealing achieved by this type of fitting may sometimes prove insufficient, especially when the skirt formed by the base of the first bottle is of relatively large diameter, i.e. approximately 3 to 5 cm. The problem is that the quality to which such a bottle can be produced, and the tolerances on the dimensions exceed those of a conventional bottle, especially those made of thermoplastic. The precariousness of this type of seal is made all the worse by the fact that in the vertical position, the sealing region is immersed in the liquid, and this may unfavourably alter the properties of the thermoplastic, thus having an appreciable effect on the seal.

Furthermore, for such a connecting part to be threaded is precluded if the packaging, especially in the vicinity of the connecting piece, is of non-circular cross-section, such as an oval cross-section. This is because, owing to manufacturing tolerances, it would be impossible to guarantee an angular position which is precise enough to achieve alignment between the skirt-like trim and the exterior surface of the first bottle and thereby achieve leaktight clamping of the connecting part onto the first bottle.

SUMMARY OF THE INVENTION

Thus, one of the objects of the invention is to provide packaging for the extemporaneous mixing of two products, which does not have the abovementioned drawbacks.

In particular, an object of the invention is to provide such a device which provides a good seal, while at the same time accommodating non-circular cross-sections.

Yet another object of the invention is to produce packaging of the aforementioned type, which is simple to produce and to use, and which is economical.

According to the invention, these and other objects are achieved by producing a packaging of the kind defined earlier, wherein the connecting means consist of two separate parts, i.e. a first part defining the top of the central hollow shaft supporting the stopper and screwed in leaktight fashion onto the skirt of the first bottle and a second part fitted onto the first part and forming a bottom of the central hollow shaft. The connecting means also includes means for preventing the second part from rotating with respect to the first part.

Thus, according to the invention, the first part, in addition to including the removable stopper, provides the leaktight closure of the opening delimited by the base of the first bottle. The second part, in addition to including means for expelling the removable stopper, advantageously includes means for aligning the second part with the exterior surface of the overall packaging, which can be constructed as a skirt. The fact that the sealing function is disconnected from the trim function allows one not to be sacrificed to the other and vice versa. What this means is that the seal can be provided by screwing the first part onto the bottle by tightening the first part onto the bottle at will. The second part can then be fitted without appreciable indexing onto the first part, at the desired angular position, so that the trim-like skirt can be aligned correctly, if need be, with respect to the rest of the packaging.

Preferably, the packaging according to the invention includes means which, after the first part has been screwed onto the base of the first bottle, prevent the said first part from rotating with respect to the first bottle. This avoids inadvertent detachment of the connecting means from the first bottle. Such means may include teeth with a profile that allows the first part to be rotated in one direction with respect to the first bottle, but prevents any rotation in the opposite direction.

According to a preferred embodiment, the second part is force-fitted onto the first part and held in place axially by a snap-fastening device. The means for preventing the second part from rotating comprises striations arranged on an internal surface of the second part and intended to interact with complementary striations borne by an external surface of the first part. The striations are produced in such a way as to cover a small angular arc (typically less than 5°), so as to allow relatively accurate alignment between a skirt-like trim borne by the second part and the first bottle. This feature is quite particularly advantageous when the packaging, at least in the vicinity of the connecting means, is of non-circular cross-section.

The stopper may be snap-fastened onto the top of the central hollow shaft.

A sealing lip may be arranged on the internal surface of the top of the central hollow shaft so as to form a seal between the internal surface and the neck when the neck is in the appropriate configuration for expelling the stopper. Other means could, however, be used to produce such a seal.

The removable closure means may consist of a cap, coupling means, particularly of a threaded type, being provided to form a coupling between the neck and the cap. The complementary entrainment means being provided on an internal surface of the bottom of the central hollow shaft and being set out in such a way that they do not interfere with the part of the coupling means provided on the neck of the second bottle.

The entrainment means preferably comprise at least one stub on an external surface of the neck and projecting radially outwards and the complementary means provided on the internal surface of the central hollow shaft comprise at least one helical ramp able to interact with the stub. In general, two stubs are provided, to which there correspond two diametrically opposed helical ramps.

According to a preferred embodiment, the coupling means consist of a screw thread, and at least one helical ramp having a pitch which exceeds that of the screw thread. Thus, for a small angle of rotation of the second bottle with respect to the first, it is possible to obtain a substantial axial movement of the neck of the second bottle inside the central hollow shaft, with a view to expelling the closure means. Thus, the axial movement of the neck relative to the central hollow shaft, necessary for expelling the stopper, can be obtained by a rotation of the second bottle through less than one turn with respect to the first.

According to a particular embodiment, the packaging according to the invention forms a volume generated by a surface which, at least in the vicinity of the connecting means, is of non-circular cross-section, for example an oval cross-section.

The bottom of the central hollow shaft may comprise an anti-back-off device capable of interacting with a stub of the second bottle. Such an anti-back-off device may comprise a projection over which the stub passes at the end of screwing in the helical ramp.

Preferably, the stub is provided on a cylindrical land, the outside diameter of which is more or less equal to the outside diameter of the cap intended to close the second bottle during storage. The inside diameter of the bottom of the central hollow shaft is preferably large enough to allow the said cylindrical land, and therefore the cap, to enter.

In the storage position, it is possible to engage the neck of the second bottle, which is fitted with the cap, in the central hollow shaft of the connecting means, and this reduces the overall size. As a preference, the packaging is set out in such a way that, in the storage position, the cap can be pushed more or less fully inside the bottom of the central hollow shaft.

According to a specific embodiment, the first part consists of a member forming a first U-shaped annular groove, comprising an inner wall, an outer wall and an end wall connecting the inner wall to the outer wall, the inner wall being extended by a smaller-diameter extension forming the top of the central hollow shaft, the internal surface of the outer wall comprising a screw thread capable of interacting with a corresponding screw thread provided on the base of the first bottle. A sealing skirt may be arranged in the closed end of the U-shaped groove between the inner wall and the outer wall, the said sealing skirt having a profile capable of interacting (particularly by crushing) with a complementary profile formed on the skirt formed by the base of the first bottle, so as to improve the seal between the first bottle and the first part. Preferably, the profile of the sealing skirt, on the side intended to interact with the base of the first bottle, is a frustoconical or an inclined shape, so that when the first part is screwed onto the first bottle, a satisfactory seal is provided, and is under the effect of a thrust exerted by a corresponding frustoconical profile provided on the internal surface of the base of the bottle.

Likewise, the second part may comprise a second U-shaped annular groove capable of receiving, under force, the first U-shaped annular groove. The second U-shaped annular groove comprises an inner wall, an outer wall, and an end wall connecting the inner wall to the outer wall, and means for axially immobilizing the said second part wherein the inner wall forms the bottom of the central hollow shaft. As a preference, a skirt-like trim is borne by the outer wall of the second annular groove.

The packaging according to the invention may be made of a thermoplastic chosen from polyethylenes (PE), polypropylenes (PP), polyethylene terephthalates (PET) and polyvinyl chlorides (PVC) or a complex of the PE/ethylene vinyl alcohol (EVOH)/PE or PE/PET type, etc.

Alternatively, the second bottle may be made of glass, which forms an effective barrier for its contents against the oxygen in the air.

Preferably, the packaging according to the invention is used for a hair colouring product, the first product being an oxidizing agent, and the second product an oxidation colorant. Alternatively, the first product may be an activator (thioglycolic acid for example) and the second product a base lotion for perming hair.

BRIEF DESCRIPTION OF THE DRAWINGS

Apart from the provisions explained hereinabove, the invention consists of a certain number of other provisions which will be explained hereinbelow, with regard to the nonlimiting embodiments described with reference to the appended Figures, among which.

DETAILED DESCRIPTION OF THE PREFERRED EMBODIMENTS

Figure 1:
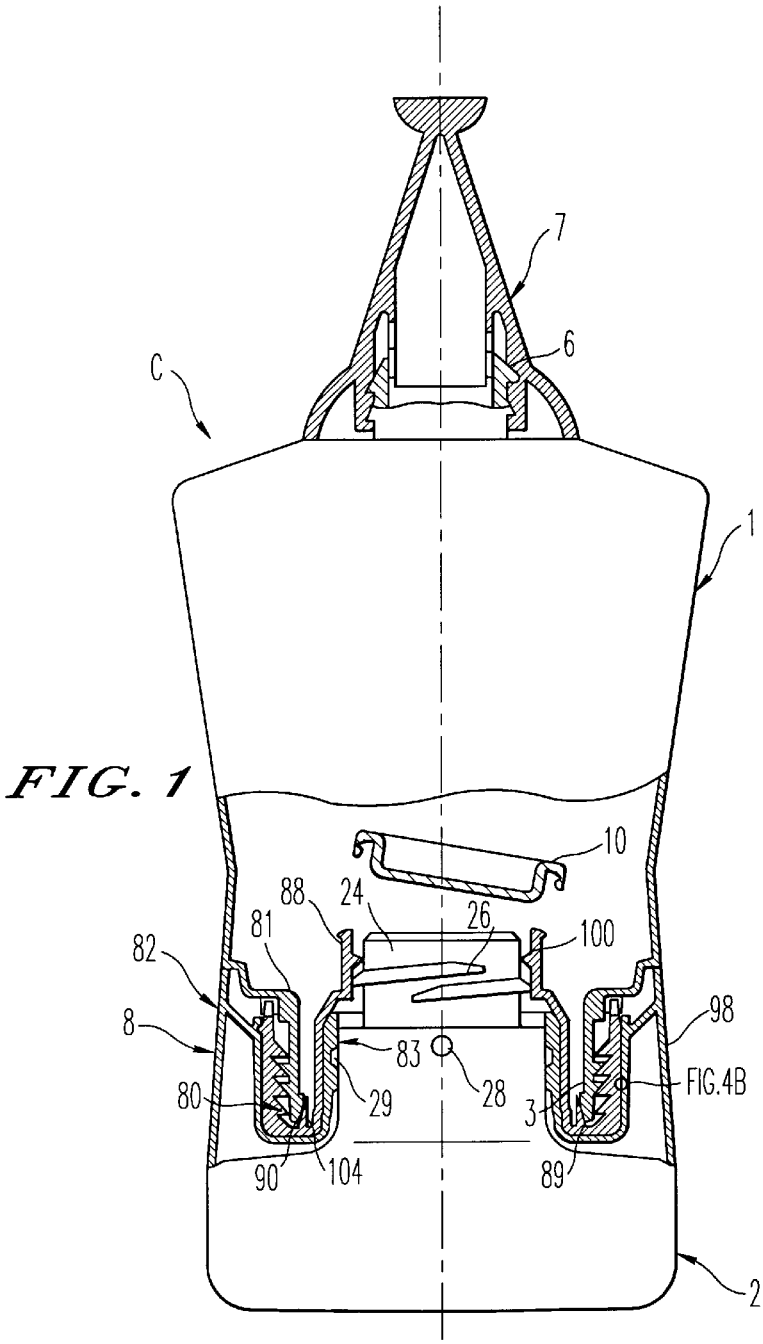
FIG. 1 depicts a view (partially in section) of one embodiment of the packaging according to the invention.

Reference to the drawings, especially to FIGS. 1 to 4A–4B, reveals a packaging C with two bottles 1, 2 which allows two products, generally two liquid products, to be stored separately from one another and to be mixed at the time of their use.

The first bottle 1 is intended to contain a first liquid product, for example an oxidizing agent, intended to be mixed, at the time of use, with an oxidation colorant contained in the second bottle, in order to dye hair.

The bottle 1 is open at its base, wherein the base comprises a cylindrical skirt 3 of circular cross-section. The skirt 3 connects to the wall of the main part of the bottle 1 by a shoulder 4. Teeth 50 are arranged uniformly around the periphery of the shoulder 4 and, as will be seen in more detail later, constitute means for locking a part 80 of a connecting means 8, onto the bottle 1. The skirt 3 is equipped, near its lower edge, with a screw thread 5 capable of interacting with a corresponding screw thread 81 provided on the part 80 of the band 8, intended to be fitted onto the skirt 3. At its top, opposite to the skirt 3, the bottle 1 has a threaded neck 6 onto which a sealed dispensing nozzle 7 can be screwed in a leaktight fashion, and the tip of which nozzle can be broken off to create an opening at the time of use, so that the product can be poured out.

An intermediate part 8, made of plastic, is produced in the form of two separate parts 80, 82 which form, when fitted together as depicted in FIG. 1, a central hollow shaft 83 of circular cross-section. The part 80 consists of a member 84 forming a first U-shaped annular groove comprising an inner wall 85, an outer wall 86, and an end wall 87 connecting the inner wall to the outer wall, the inner wall 85 being extended by a smaller-diameter extension 88 forming the top of the central hollow shaft 83. This smaller-diameter portion 88 is able to receive a stopper 10, which may be fitted in leaktight fashion, for example by snap-fastening, onto the free edge of the extension 88. The stopper 10 may be detached from the central hollow shaft 83 by the exertion of a thrust on stopper 10, in the direction of bottle 1, into which the stopper thus detached will penetrate.

The inner surface of the outer wall 86 comprises a screw thread 81 capable of interacting with a corresponding screw thread 5 provided on the base 3 of the first bottle 1. A sealing skirt 89 may be arranged in the closed end 87 of the U-shaped groove between the inner wall 85 and the outer wall 86, the surface of the said sealing skirt facing the outer wall 86 having a frustoconical or inclined profile 90 capable of deforming radially inwards when the first part is screwed onto the bottle 1, under the pressure exerted by a corresponding frustoconical (or inclined) profile 104 formed on the interior surface of the skirt 3, so as to improve the seal between the first bottle 1 and the first part 80. Other sealing profiles may also be used according to the invention.

Figure 4A:
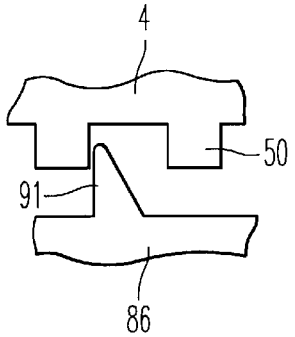
FIGS. 4A and 4B illustrate views of details of the packaging of FIG. 1.
Figure 4B:
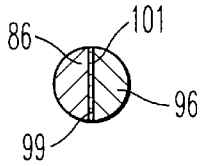

The free edge of the outer wall 86 bears teeth 91, capable of engaging, when the part 80 is screwed onto the base of the bottle 1, with the corresponding teeth 50 provided on the shoulder 4 formed by the base of the bottle 1. As depicted in FIG. 4A, the teeth 91 have, on one side, a straight edge and, on the other side, an edge forming a ramp to allow the teeth 91 to pass over the teeth 50 when the part 80 is being screwed onto the bottle 1, and to prevent any rotation of the part 80 in the opposite direction with respect to the bottle 1. A snap-fit ridge 92 is arranged on the outer surface of the outer wall 86 of the U, to interact, by snap-fastening, with a groove 93 provided on the part 82. A sealing lip 100 is arranged on the internal surface of the extension 88, near its free edge, so as to form a seal with the neck of the second bottle 2 when mixing is being performed (the position illustrated in FIG. 1).

Figure 2:
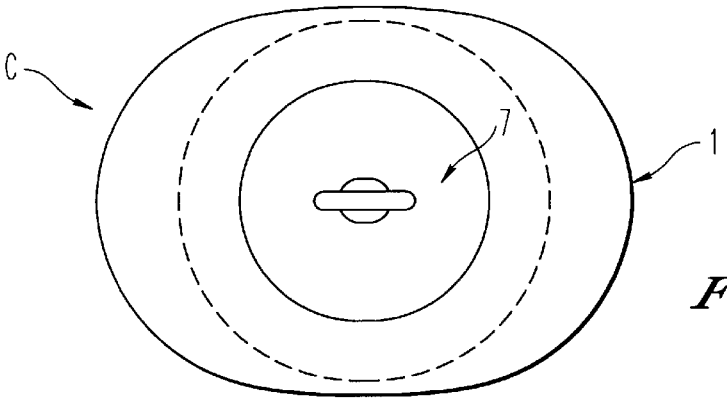
FIG. 2 is a view from above of the embodiment of FIG. 1.
Figure 3:
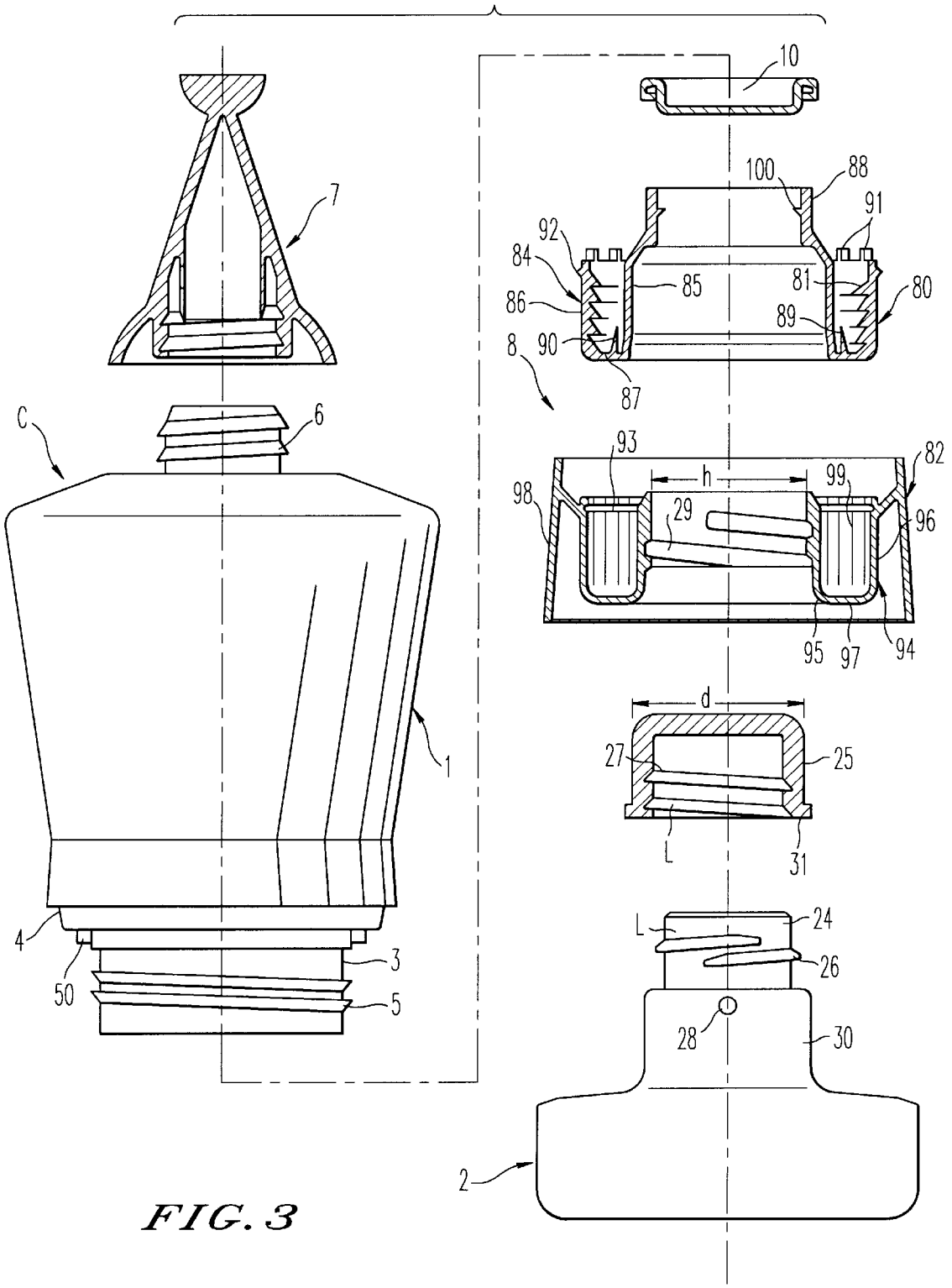
FIG. 3 is an exploded view of the packaging of FIG. 1.

Likewise, the second part 82, forming the connecting part 8, comprises a second U-shaped annular groove 94 capable of receiving by force the first U-shaped annular groove 84. The said second U-shaped annular groove comprises an inner wall 95, an outer wall 96, and an end wall 97 connecting the inner wall to the outer wall, the inner wall 95 forming the bottom of the said central hollow shaft 83. The internal dimensions of the groove 94 slightly exceed the external dimensions of the groove 84 so that the part 82 can be force-fitted onto the part 80. In this embodiment, the top 88 of the central hollow shaft 83 has a slightly smaller cross-section than the bottom 95. A skirt-like trim 98, the cross-section of which has a shape similar to that of the cross-section of the bottle 1, is borne by the outer wall 96 of the annular groove 84. This shape is preferably oval, as can be seen in FIG. 2.

The part 82 is fitted onto the part 80, after 80 has been screwed onto the skirt 3 of the bottle 1, by forcibly inserting the annular groove 84 into the annular groove 94. In order to prevent one from rotating with respect to the other, the internal surface of the outer wall 96 has striations 99, capable of interacting with corresponding striations 101 (see detailed view of FIG. 4B) provided on the external surface of the outer wall 86 of the first part 80. The positioning obtained can be made accurate enough if the striations are produced in such a way that they delimit a small angular portion (typically smaller than 5°). Part 82 can be axially immobilized with respect to 80 by means of the snap-fastening groove 93 provided on the internal surface of the outer wall 96, wherein snap-fastening groove 93 is configured to cooperate with the ridge 92 provided on the part 80. When the parts 80 and 82, provided with the stopper 10, are fitted onto the bottle 1 as shown in FIG. 5, the bottle is closed in a sealed fashion at its bottom.

The bottom of the central hollow shaft 83 can receive the neck 24 of the second bottle 2, which contains the colorant. The neck 24 is equipped, with a cap 25, for leaktight closure during storage.

Coupling means L are provided for forming a coupling between the neck 24 and the cap 25. Coupling means L may comprise a screw thread 26 provided on the outer cylindrical surface of the neck 24, and a mating screw thread 27 provided on the internal cylindrical surface of the cap 25. The pitch of the screw thread 26 (and of the screw thread 27) is preferably small. Alternatively, the neck 24 of the bottle 2 can be sealed by a thermally welded membrane, or some other equivalent means.

Figure 5:
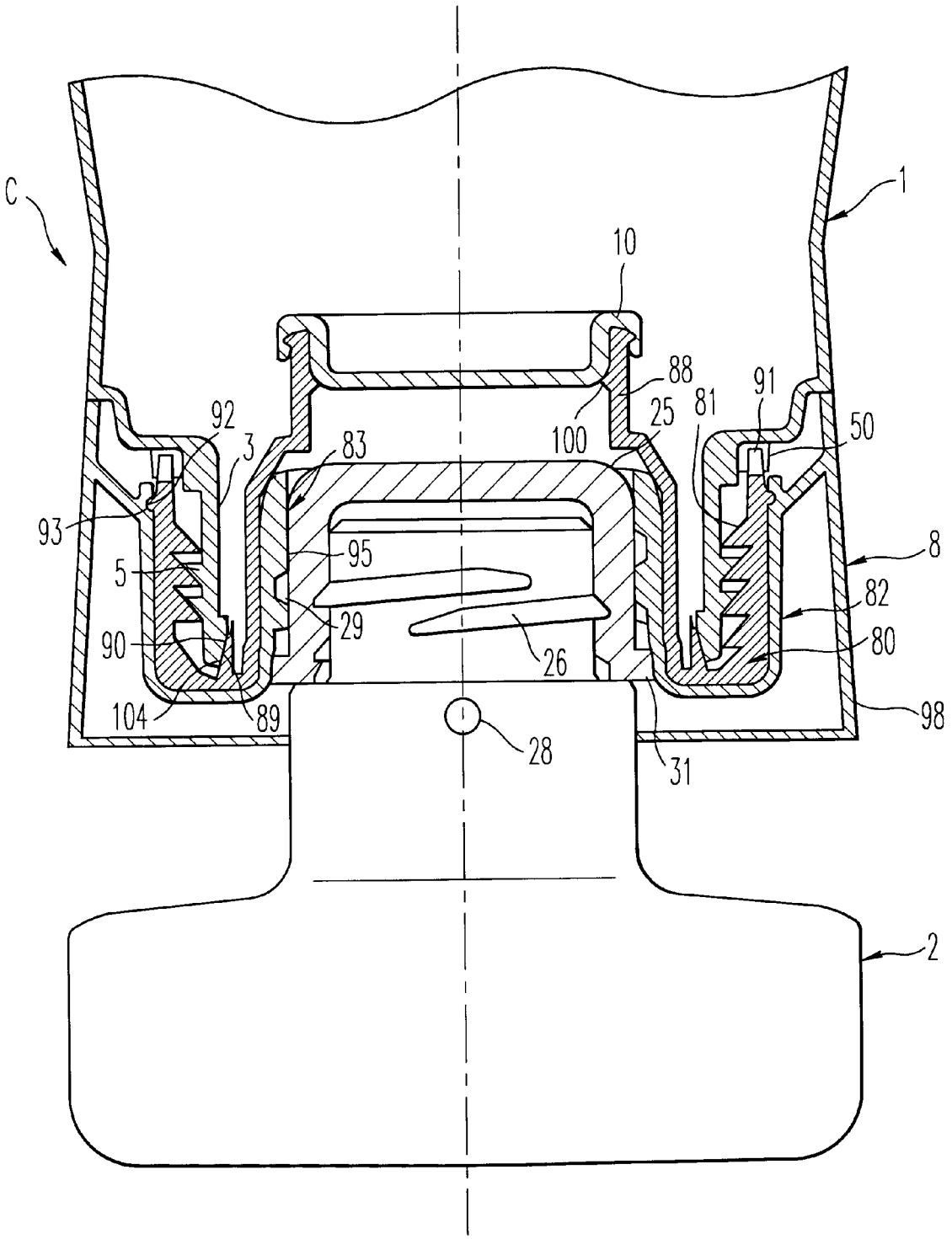
FIGS. 5 and 6 are views partially in section of the packaging according to FIG. 1, for the purpose of illustrating how it is used.

Advantageously, the outside diameter d of the cap 25 is slightly smaller than the inside diameter h of the bottom 95 of the central hollow shaft 83, which means that the cap 25 can be inserted into this hollow shaft, as depicted in FIG. 5.

Entrainment means 28, in the form of two diametrically opposed stubs, are arranged on the neck 24. Complementary entrainment means 29 are provided on the internal surface of the bottom of the central hollow shaft 83. Such complementary means may consist of two helical ramps 29 capable of interacting respectively with the stubs 28. The pitch of the ramps is preferably markedly greater than the pitch of the screw thread 26. Advantageously, the pitch of the helical ramps 29 is chosen to be such that the axial travel of the neck 24, relative to the central hollow shaft 83, which is necessary for driving out the stopper 10, is obtained for a rotation of the neck 24 of less than one turn relative to the connecting means 8. The combination of the stubs 28 and of the helical ramps 29 makes it possible to ensure a precise angular position of the bottle 2 relative to the connecting means 8, on completion of assembly between the stubs 28 and the ramps 29.

The cylindrical interior surface of the bottom 95 of the central hollow shaft 83 has a diameter h larger than the maximum outside diameter of the screw thread 26, so that the helical ramps 29 cannot interfere with the screw thread 26 when the neck 24, freed of its cap 25, is introduced into the hollow shaft 83.

The stubs 28 are provided on a cylindrical land 30 which projects radially from the neck, the outside diameter of which is approximately equal to the outside diameter d of the cap 25. This cylindrical land 30 can therefore be inserted into the bottom of the central hollow shaft 83.

An anti-back-off device (not depicted) may be produced from a projection provided on the upper end of each helical ramp 29. The corresponding stub 28 is intended to pass over this projection at the end of screwing, this passage being ensured by elastic deformation. When the stub 28 has passed over the projection, the latter blocks the stub and thus opposes any unscrewing of the bottle 2 from the connecting part 8.

The skirt-like trim 98 of the part 82 fits over the second bottle 2, at the end of connection (see the position illustrated in FIG. 1). Clipping-in, which by a slight noise signals the end of travel of the bottle 2 and the release of the stopper 10, may be provided between the bottom of the skirt 98 and the bottle 2, and additionally constitutes an additional device to prevent unscrewing.

In the embodiment illustrated in the drawings, as visible in particular in FIG. 5, the cap 25 at its bottom has a collar 31 projecting radially outwards and restricting the degree to which the cap 25 can enter the hollow shaft 83, for the storage position.

The bottles are filled, stored and used as follows. The stopper 10 is fitted onto the top 88 of the central hollow shaft 83. The part 80 is then screwed in leaktight fashion onto the skirt 3 of the bottle 1. The bottom of the bottle is thereby closed in a leaktight fashion. The second part 82 is then force-fitted onto the part 80. Its angular position is adjusted in such a way as to align the skirt-like trim 98 with the bottle 1. The bottle 1 is then filled, for example with oxidizing fluid, through the opening at its top. The dispensing nozzle 7 is then screwed onto the neck at the top of the bottle 1.

The bottle 2 is then filled, for example with colorant, then closed in a sealed way by the cap 25 which is screwed onto the neck 24.

If appropriate, the bottles 1 and 2 may be stored separately. However, as a preference, for storage, the cap 25 fixed to the neck 24 is fitted into the bottom of the hollow shaft 83, in the way illustrated in FIG. 5.

Figure 6:
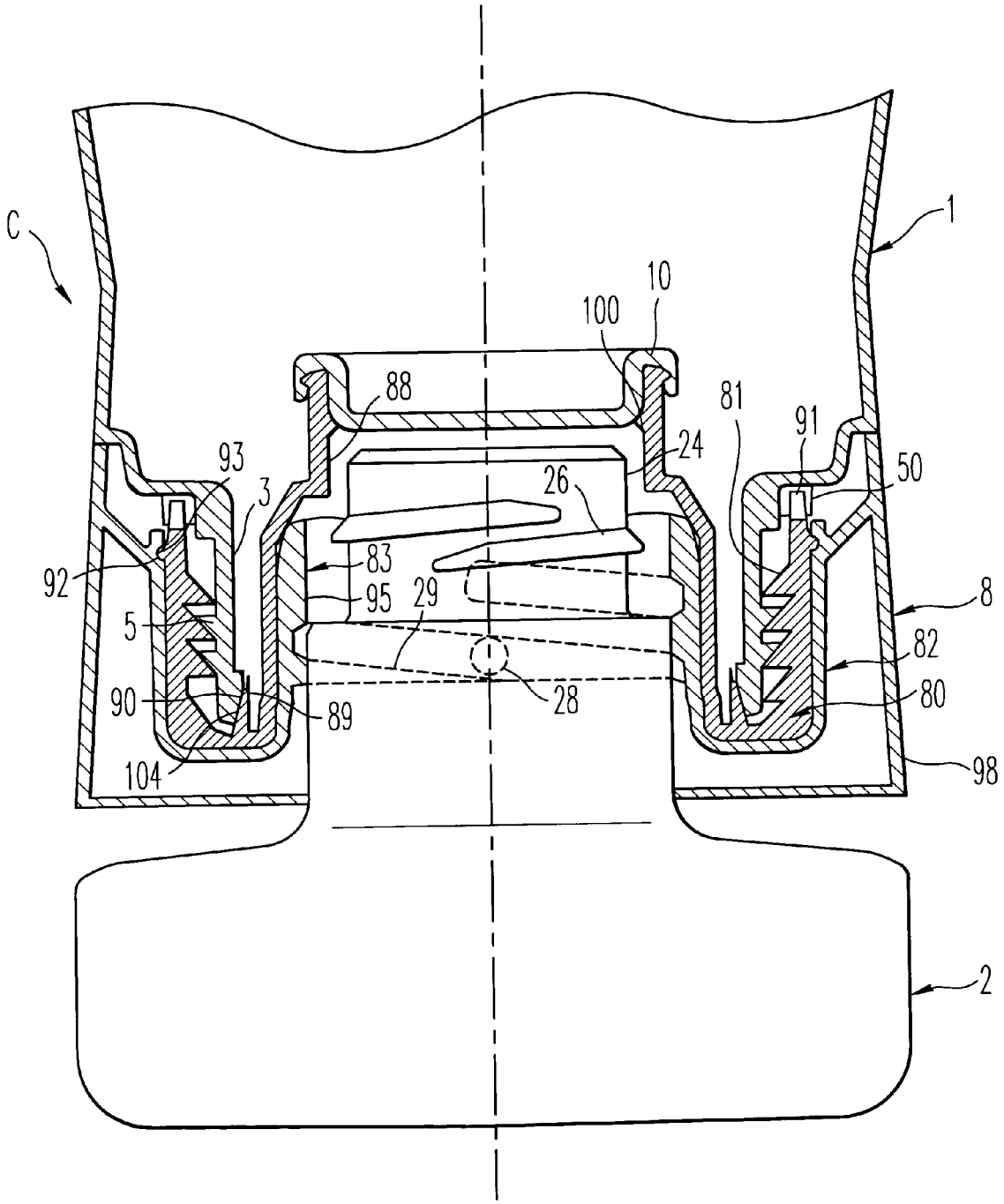

When the operator wishes to use the packaging to mix the two liquids, the operator removes the bottle 2 from the connecting means 8 and unscrews the cap 25. The operator then introduces the neck 24 into the hollow shaft 83 and pushes the neck in axially, rotating it, until the stubs 28 engage with the base of the helical ramps 29. By a rotational movement of the bottle 2 relative to the intermediate part 8, the operator makes the stubs 28 travel up the ramps 29, as illustrated in FIG. 6.

At the end of the axial travel, the top of the neck 24 drives out the stopper 10 and thereby opens bottle 1. In the meantime, the sealing lip 100 has come into leaktight contact with the external surface of the neck 24, as illustrated in FIG. 1. Preferably, expulsion means, such as bosses, are provided on a portion of the periphery of the stopper 10, to make the stopper easier to expel. For example, bosses may be provided along a 90° portion of the periphery of stopper 10. What these bosses do is localize the expulsion force exerted by the neck 24, initially onto just an angular portion of the stopper. The required expulsion force is thereby reduced as an expulsion force exerted in the same way over the entire periphery of the stopper 10 would require a greater expulsion force.

If need be, the stubs 28 are halted in their end-of-screwing position, by screwing stops provided in the ramps 29. The operator, having shaken the packaging thus produced, can then open the dispensing nozzle 7 with a view to applying the mixture. The bottle 2 remains attached in leaktight fashion to the bottle 1 during application of the product.

In the foregoing detailed description, reference was made to preferred embodiments of the invention. It is obvious that variations can be made thereto without departing from the spirit of the invention as claimed hereafter.

I claim:

1. Packaging for the extemporaneous mixing of two products, comprising:

a first bottle intended to contain a first product, said first bottle having a base, a skirt attached to said base, and a dispensing nozzle provided at a top end of said first bottle, wherein said skirt defines an aperture;

connecting means fixed to the base of the first bottle, wherein said connecting means includes a central hollow shaft capable configured to receive, at a first end, a detachable stopper configured to close said first bottle;

a second bottle intended to contain a second product, said second bottle including a neck configured to engage said central hollow shaft, said neck being equipped with a removable closure means, said neck provided with entrainment means which are configured to cooperate with complementary means provided on the central hollow shaft, such that said stopper is expelled when entrainment means and said complementary means are engaged and the first and second products can thereby be mixed;

wherein the connecting means comprises a first part which includes the top of the central hollow shaft supporting the stopper, a second part which is fitted onto said first part and forms a bottom of the central hollow shaft and includes the said complementary means, and means for preventing the second part from rotating with respect to the first.

2. Packaging according to claim 1, further comprising means for preventing said first part from rotating with respect to the first bottle.

3. Packaging according to claim 1, wherein the second part is force-fitted onto the first and held in place axially by a snap-fastening device, wherein the means for preventing the second part from rotating comprises striations arranged on an internal surface of the second part which are configured to interact with complementary striations provided on an external surface of the first part.

4. Packaging according to claim 1, wherein the stopper is snap-fastened onto the top of the central hollow shaft.

5. Packaging according to claim 1, wherein a sealing lip is arranged on an internal surface of the top of the central hollow shaft wherein said lip is configured to form a seal between the said internal surface and the neck.

6. Packaging according to claim 1, wherein said removable closure means comprises a cap, threaded coupling means having threads configured to form a coupling between the neck and the cap, wherein the complementary means are provided on an internal surface of the central hollow shaft and configured such that they do not interfere with the threads of the coupling means provided on the neck of the second bottle.

7. Packaging according to claim 1, wherein the entrainment means comprise at least one stub which projects radially outward from on an external surface of the neck, and wherein the complementary means provided on the internal surface of the central hollow shaft comprise at least one helical ramp configured to interact with the stub.

8. Packaging according to claim 7, wherein the entrainment means comprises two diametrically opposed stubs, and wherein the complementary means comprises two diametrically opposed helical ramps.

9. Packaging according to claim 6, wherein the coupling means comprises a screw thread, and wherein a pitch of the helical ramp exceeds a pitch of the screw thread.

10. Packaging according to claim 9, wherein the entrainment means and the complementary means are configured to cause the neck to move axially into the central hollow shaft in response to the second bottle being rotated with respect to the first, and wherein the pitch of the helical ramp is such that the axial movement of the neck relative to the central hollow shaft necessary for expelling the stopper, is obtained by a rotation of the second bottle through less than one turn with respect to the first bottle.

11. Packaging according to claim 1, further comprising a volume generated by a surface which, at least in the vicinity of the connecting means, is of non-circular cross-section.

12. Packaging according to claim 11, wherein said volume is generated by a surface of oval cross-section.

13. Packaging according to claim 7, wherein the bottom of the central hollow shaft comprises an anti-back-off device capable of interacting with a stub of the second bottle.

14. Packaging according to claim 7, wherein the closure means comprises a cap, wherein the stub is provided on a cylindrical land with an outside diameter approximately equal to the outside diameter of said cap, and wherein the inside diameter of the bottom of the central hollow shaft is large enough receive said cylindrical land or said cap.

15. Packaging according to claim 14, wherein a storage position corresponds to a position wherein the cap can be pushed fully inside the bottom of the central hollow shaft.

16. Packaging according to claim 1, wherein the first part consists of a member forming a first U-shaped annular groove, said groove comprising an inner wall, an outer wall and an end wall connecting the inner wall to the outer wall, the inner wall being extended by a smaller-diameter extension forming the top of the central hollow shaft, and wherein the internal surface of the outer wall includes a screw thread capable of interacting with a corresponding screw thread provided on the base of the first bottle.

17. Packaging according to claim 16, wherein a sealing skirt is arranged in the closed end of the U-shaped groove between the inner wall and the outer wall, said sealing skirt having a profile capable of interacting in sealed fashion with a profile of the skirt formed by the base of the first bottle.

18. Packaging according to claim 16, wherein the second part comprises a second U-shaped annular groove capable of receiving the first U-shaped annular groove, and means for axially immobilizing the said second part, wherein said second U-shaped annular groove comprises an inner wall, an outer wall, and an end wall connecting the inner wall to the outer wall, said inner wall forming the bottom of the said central hollow shaft.

19. Packaging according to claim 18, wherein a skirt-like trim is provided on the outer wall of the second annular groove.

20. Packaging according to claim 1, wherein said packaging is made of a thermoplastic chosen from polyethylenes (PE), polypropylenes (PP), polyethylene terephthalates (PET) and polyvinyl chlorides (PVC) or a complex of the PE/ethylene vinyl alcohol (EVOH)/PE or PE/PET.

21. Packaging according claim 1, wherein the first product is an oxidizing agent and the second product is an oxidation colorant.

22. Packaging according to claim 1, wherein the first product is an activator and the second product is a base lotion for perming hair.

* * * * *

UNITED STATES PATENT AND TRADEMARK OFFICE

CERTIFICATE OF CORRECTION

PATENT NO. : 5,908,107
DATED : June 1, 1999
INVENTOR(S) : Gilles Baudin

It is certified that error appears in the above-identified patent and that said Letters Patent is hereby corrected as shown below:

Column 7, claim 1,
Line 57, delete "capable".

Signed and Sealed this

First Day of January, 2002

*Attest:*

*Attesting Officer*

JAMES E. ROGAN
*Director of the United States Patent and Trademark Office*